United States Patent [19]

Spurk

[11] 4,091,709

[45] May 30, 1978

[54] RECOILLESS RIFLE NOZZLE

[75] Inventor: Joseph H. Spurk, Bad König, Germany

[73] Assignee: The United States of America as represented by the Secretary of the Army, Washington, D.C.

[21] Appl. No.: 824,672

[22] Filed: Aug. 15, 1977

Related U.S. Application Data

[63] Continuation of Ser. No. 708,967, Jul. 26, 1976, abandoned.

[51] Int. Cl.[2] ..... F41F 3/02

[52] U.S. Cl. ..... 89/1.703; 89/1.704; 239/265.11

[58] Field of Search ..... 89/1.703, 1.704, 1.7; 181/46, 33 HB; 239/265.11, 265.25

[56] References Cited

U.S. PATENT DOCUMENTS

| | | | |
|---|---|---|---|
| 2,444,949 | 7/1948 | Musser | 89/1.704 |
| 2,677,231 | 5/1954 | Cornelius | 181/46 X |
| 2,696,760 | 12/1954 | Musser | 89/1.703 |
| 3,025,667 | 3/1962 | Moorehead | 239/265.25 |
| 3,035,494 | 5/1962 | Musser | 89/1.703 |
| 3,050,937 | 8/1962 | James et al. | 239/265.25 UX |
| 3,052,090 | 9/1962 | Herzog | 239/265.11 |
| 3,053,340 | 9/1962 | Kutney | 239/265.11 X |
| 3,251,552 | 5/1966 | Ford | 239/265.11 X |
| 3,446,111 | 5/1969 | Dardick | 89/1.7 |
| 3,490,330 | 1/1970 | Walter | 89/1.7 |

*Primary Examiner*—David H. Brown

*Attorney, Agent, or Firm*—Nathan Edelberg; Harold H. Card, Jr.; A. Victor Erkkila

[57] ABSTRACT

A plate having a plurality of small openings therein mounted to the exit port of a recoilless weapon for reducing the depth of penetration of the disturbed gas field without significantly effecting the recoil reduction characteristics of the weapon.

4 Claims, 4 Drawing Figures

FIG. 1
PRIOR ART
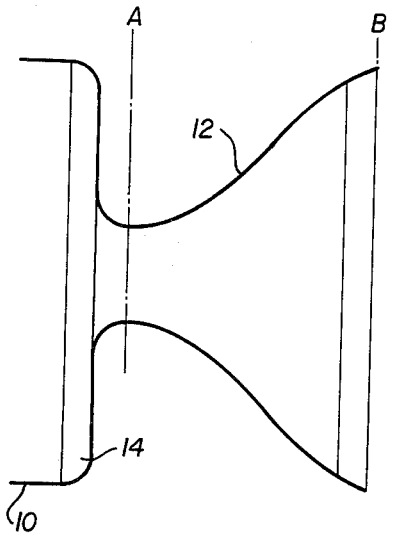
FIG. 2
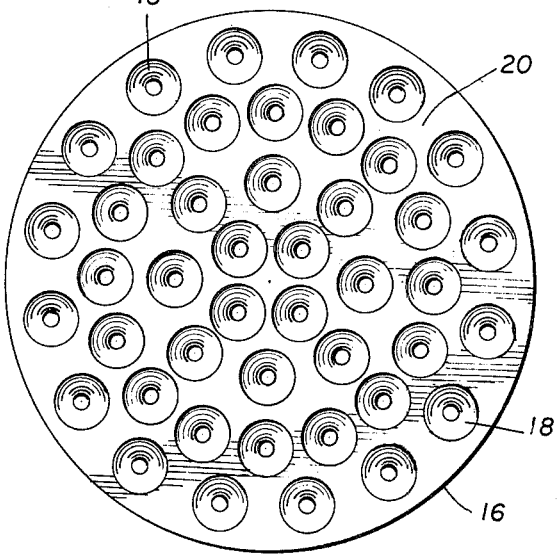
FIG. 3
PRIOR ART
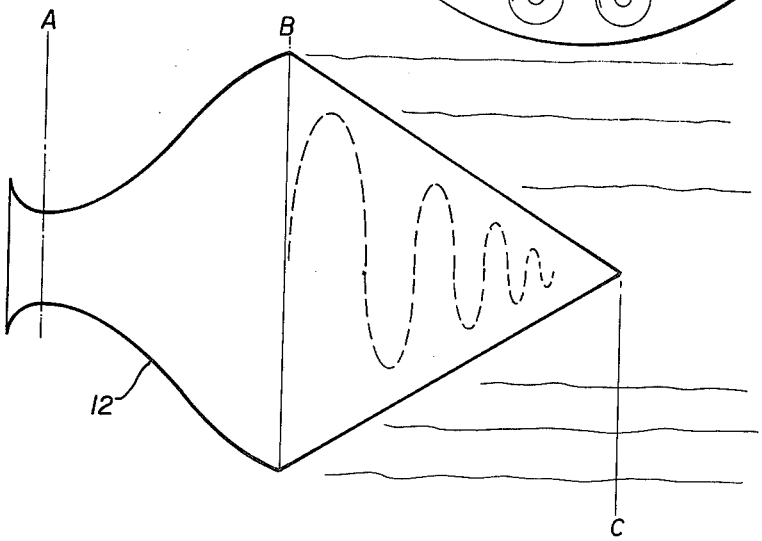
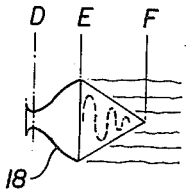
FIG. 4

RECOILLESS RIFLE NOZZLE

This is a continuation of application Ser. No. 708,967, filed July 26, 1976, now abandoned.

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention relates generally to recoilless weapons and more specifically to a recoilless weapon with reduced depth of penetration of the disturbed gas field.

2. Description of the Prior Art

In the field of weapon design, the major concern has been the development of recoilless rifles. A portion of a typical recoilless rifle is illustrated in FIG. 1 as including combustion chamber 10 having a single nozzle 12 mounted to exit port 14 at the rear of combustion chamber 10. The recoil of a given weapon is a function of the ratio of the area at the throat A to the area at the exit B of the nozzle, and the total cross-sectional area B. The single nozzle of the prior art, illustrated in FIG. 1, has a venturi longitudinal cross-section.

Other prior art nozzles use the cross-sectional area of the bore or combustion chamber as the throat portion of a venturi and a substantially increased diameter section as the flared portion of the venturi. Positioned on the exit area of the flared portion is generally a center nozzle of the same diameter as the weapon's bore and a plurality of smaller diameter nozzles in a ring around the center nozzle. The recoil compensation of these weapons is produced by the flared portion of the venturi not necessarily the nozzle. While the ring of small diameter nozzle provides rotational stabilization, the center nozzle is the main gas outlet.

The main disadvantages of the nozzles for recoilless weapons of the prior art are that they produce a large danger zone behind the weapon and excessive noise generation. Both of these disadvantages are a function of the penetration depth of the disturbed gas field extending from the rear of the weapon which is directly related to the cross-sectional area B of the nozzle. Since prior art development has been directed to decreasing the recoil of a weapon, major effort has been to increase the cross-sectional area B of the device illustrated in FIG. 1. Thus weapon designers have increased the depth of penetration producing a larger danger zone and excessive noise in order to decrease recoil. A need therefore exists for a recoilless weapon with reduced danger zone and noise levels without sacrificing the recoil reduction characteristics of present weapons.

SUMMARY OF THE INVENTION

The present invention is a nozzle for a recoilless weapon which reduces the danger zone and the noise level without modifying the recoil reduction characteristics of the weapon. A plate having a plurality of small openings is mounted directly to the rear of the combustion chamber of the weapon. Each opening has a ratio of throat cross-sectional area to exit cross-sectional area equal to that of a single nozzle to produce a given recoil reduction and the sum of the cross-sectional exit areas of the plurality of openings is approximately that of the exit area of the single nozzle. Each of the plurality of the openings has a venturi longitudinal cross-section and they are substantially evenly distributed over the plate.

OBJECTS OF THE INVENTION

An object of the present invention is to provide a device which decreases the noise levels of a recoilless weapon.

Another object of the present invention is to provide a device which decreases the danger zone behind a recoilless weapon.

An even further object of the present invention is to provide a device which reduces the danger zone and noise level of a recoilless weapon without sacrificing recoil reduction characteristics.

And still another object of the present invention is to provide a device for use in a recoilless weapon which does not increase the length or expense of producing a recoilless weapon of reduced penetration depth of the disturbed gas field.

Other objects, advantages and novel features of the present invention will become apparent from the following detailed description of the invention when considered in conjunction with the accompanying drawings.

BRIEF DESCRIPTION OF THE DRAWINGS

FIG. 1 is a cross-sectional view of a single nozzle recoilless weapon of the prior art;

FIG. 2 is an end view of a preferred embodiment of the nozzle plate of the present invention;

FIG. 3 is a schematic representation of the gas flow of the single nozzle of FIG. 1; and FIG. 4 is a schematic of the gas flow of a single opening of the nozzle plate of FIG. 2.

DESCRIPTION OF THE PREFERRED EMBODIMENTS

A nozzle for use in a recoilless weapon is shown in FIG. 2 as a circular plate 16 having a plurality of openings 18 therein. The nozzle plate 16 is mounted in the exit port 14 of combustion chamber 10 replacing the single nozzle 12 of FIG. 1. The nozzle plate 16 is illustrated as having twenty-eight openings distributed substantially equally over its surface. The particular spatial relationship of the openings 18 relative to each other and their number in FIG. 2 is merely an illustration of one of many possible combinations of arrangement of openings and possible number of openings. Specific design of their layout on the plate 16, their size, and their number is dependent upon the desired recoil reduction characteristics, noise level, and danger zone depth, which are subject to the design criteria to be described.

The individual openings 18 in plate 16, one of which is illustrated in FIG. 4 as having a venturi shape, are geometrically similar to the venturi shape of the single nozzle 12 illustrated in FIG. 3. Whereas the prior art single nozzle has a throat cross-sectional area A and an exit cross-sectional area B, each of the openings 18 has a throat cross-sectional area D and an exit cross-sectional area E.

The concept of the present invention is to reduce the penetration depth of the disturbed gas field so as to reduce the danger zone behind the weapon as well as the noise levels without significantly modifying the recoil reduction characteristics of the weapon. To achieve this, the present invention utilizes a plurality of small openings recoilwise equivalent to the single nozzle 12. In order to retain the recoil characteristics of the single nozzle 12, the ratio of the throat area to the exit area of each opening 18 is equal to the ratio of the throat area to the exit area of the single nozzle 12 and is expressed as:

$$\frac{\text{Area } A}{\text{Area } B} = \frac{\text{Area } D}{\text{Area } E} \qquad \text{Condition I}$$

Furthermore, in order to maintain the recoil reduction characteristics, the exit area of the nozzle plate must be approximately equal to B. Therefore, the sum of the exit areas E must approximate that of B. This condition is expressed as:

$$\Sigma \text{ Area E} = \text{Area B Condition} \longrightarrow \text{II}$$

Since the area B is generally equal to the exit port 14 of the combustion chamber, the sum of the exit areas E cannot equal the area of B. Referring to FIG. 2, the area 20 between the openings 18, no matter how tightly the openings 18 are packed, will prevent the sum of the exit areas E of 18 to be equal to the area of B. To more accurately satisfy condition II, the diameter of plate 16 may be greater than the exit port 14 of chamber 10 and mounted to the exit port 14 by an adapter. Thus, if the ratio of the throat to exit areas for the single nozzle is equal to that of the individual openings 18 of plate 16 and the sum of the exit areas E of openings 18 is equal to B, the recoil reduction characteristics of the single nozzle 12 is substantially reproduced by the nozzle plate 16.

The reduction of the penetration depth of the disturbed gas flow, so as to reduce the blast and noise fields behind the recoilless gun, is illustrated by the comparison of the gas flow or fields in FIG. 3 and 4 for the single nozzle and for one of the openings 18 of the nozzle plate 16 respectively. The generally conical region is the disturbed gas field and the area outside of the conical region is the dissipated field wherein the disturbed gas has dissipated into the atmosphere. This conical shape also represents the danger zone behind a weapon known as the blast and the noise field. The depth of penetration is defined as the distance from the exit area B to the point at which the cone crosses the center line or C. It should be noted that the illustrations of FIG. 3 and FIG. 4 are not approximations of the exact field such that the relationship between the distance from B to C relative to the radius or the diameter of the cross-section B can be derived from these figures.

In contrast to FIG. 3, the depth of penetration of the disturbed gas field for the opening 18 is illustrated in FIG. 4 as being between the exit area E and the point F. As noted previously, the cross-section in FIG. 4 of the opening 18 is a venturi and geometrically similar to the venturi shape illustrated in FIG. 3 of the single nozzle 12. Although the dimensions of the conical shape between E and F of FIG. 4 is not to be representative of its relationship to the radius or diameter of the cross-sectional area E, FIG. 3 and 4 do illustrate the geometrical similarity of the conical region formed between B and C to the conical region formed between E and F. By reducing the venturi shaped nozzle from the dimensions of 12 to that of 18, the depth of penetration is proportionally reduced. Thus, if the radius or diameter of E is one-tenth of the radius or diameter of B, the depth of penetration E-F is one-tenth the depth of penetration B-C. In the most ideal case, where the openings 18 on plate 16 are so arranged spatially that they do not aerodynamically interfere with each other, the depth of penetration of the disturbed gas field is reduced proportional to the reduction in the radius or diameter of the exit area E relative to the exit area B.

In order to meet the requirements of condition II listed above, the number of openings is sufficiently large and packed very densely onto the plate 16. The disturbed gas fields of these closely arranged individual openings 18 do aerodynamically interact. Thus the reduction of the depth of penetration of the disturbed gas field is not directly proportional to the radius of the exit areas E to B. Though the exact amount of reduction depends upon the packing density, distance of separation, and diameter of the exit area E, even aerodynamically interfering disturbed gas fields do provide a reduction in the depth of penetration of the disturbed gas fields. Thus the present invention is a totally different approach to the design of nozzles for recoilless weapons in that the design approach is to minimize the depth of penetration without sacrificing recoil reduction characteristics. Since the blast and noise field are dependent upon the penetration depths of the disturbed gas field, the small openings 18 in the nozzle plate 16 significantly reduce these unwanted effects.

It is evident from the above description that the objects of the invention are obtained and that the present invention provides a nozzle plate for a recoilless weapon which reduces the depth of penetration without significantly varying the recoil reduction characteristics of a weapon. Even though the openings have been illustrated as venturi in shape, they may be any shape the designer should choose. Similarly, the number of openings and their position on the plate may vary with various applications. Though the plate can be mounted directly in the exit port 14 of the rear chamber 10, an adapter may be provided such that the plate 16 will be of a greater diameter than the diameter of the chamber 10 so as the sum of the areas E of the individual openings 18 will more closely approximate the total exit area B of a single desirable nozzle characteristic.

I wish it to be understood that I do not desire to be limited to the exact details of construction shown and described, for obvious modifications can be made by a person skilled in the art.

What is claimed:

1. In a gun having a combustion chamber, an exit port in said combustion chamber and a means in said exit port for producing recoil reduction, the improvement being said recoil reduction means, which comprises a plate mounted in the exit port, said plate having a larger diameter than said exit port and containing a plurality of small venturi shaped nozzles, the sum of the exit areas of said nozzles being approximately equal to the exit area of a single large venturi shaped nozzle when mounted in said exit port, wherein said single large nozzle has the same ratio of throat area to exit area as said small nozzles and an exit diameter approximately equal to that of the exit port, whereby as compared to said single large nozzle, the plurality of small nozzles provides a substantially reduced penetration depth of the distorted gas field extending from said exit port and substantially equal recoil reduction characteristics.

2. In a gun according to claim 1, wherein the small nozzles and the single large nozzle are geometrically similar, and the small nozzles are substantially equal in size and substantially evenly distributed in said plate.

3. A method of reducing the penetration depth of the disturbed gas field extending from a single large venturi shaped nozzle for producing a predetermined amount of recoil reduction mounted in the exit port of a recoilless type gun, without significantly sacrificing the recoil characteristics thereof, which comprises replacing said single large venturi shaped nozzle with a plate mounted in said exit port, which contains a plurality of small venturi shaped nozzles possessing the same ratio of throat area to exit area as said single nozzle, the sum of the exit areas of said plurality of small nozzles being approximately equal to the exit area of said single large nozzle.

4. A method according to claim 3, wherein the small nozzles and the single large nozzle are geometrically similar, and the small nozzles are substantially equal in size and substantially evenly distributed in said plate.

* * * * *